US007263840B2

(12) United States Patent
Hackman et al.

(10) Patent No.: US 7,263,840 B2
(45) Date of Patent: Sep. 4, 2007

(54) AUTOMATIC LN2 DISTRIBUTION SYSTEM FOR HIGH-PURITY GERMANIUM MULTI-DETECTOR FACILITIES

(75) Inventors: Gregory Hackman, Delta (CA); Jennifer Braun, Vancouver (CA); Donald J. Dale, Richmond (CA); David Blair Morris, Vancouver (CA)

(73) Assignee: Triumf, Vancouver, BC (CA)

( * ) Notice: Subject to any disclaimer, the term of this patent is extended or adjusted under 35 U.S.C. 154(b) by 499 days.

(21) Appl. No.: 10/689,951

(22) Filed: Oct. 22, 2003

(65) Prior Publication Data

US 2005/0086964 A1 Apr. 28, 2005

(51) Int. Cl.
*F17C 13/02* (2006.01)
*B65B 63/08* (2006.01)

(52) U.S. Cl. ..... 62/49.1; 62/60

(58) Field of Classification Search ..... 62/49.1, 62/50.2, 50.4, 50.6, 50.7, 64
See application file for complete search history.

(56) References Cited

U.S. PATENT DOCUMENTS 3,952,531 A * 4/1976 Turner ..... 62/45.1
4,091,294 A * 5/1978 Zankl et al. ..... 318/773
4,295,339 A * 10/1981 Kuraoka et al. ..... 62/64
4,506,512 A * 3/1985 Delacour et al. ..... 62/49.2
4,988,014 A * 1/1991 Varghese et al. ..... 62/45.1
5,142,874 A * 9/1992 Maric ..... 62/49.2
5,329,777 A * 7/1994 Weltmer, Jr. ..... 62/49.2
5,566,733 A * 10/1996 Germain ..... 141/192
5,660,046 A * 8/1997 de Langavant et al. ..... 62/50.3
5,878,597 A * 3/1999 Mueller et al. ..... 62/646
6,016,697 A * 1/2000 McCulloch et al. ..... 73/304 C
6,374,618 B1 * 4/2002 Lak ..... 62/50.1
6,505,470 B1 1/2003 Drube et al.
6,810,925 B2 * 11/2004 Graham et al. ..... 141/98

FOREIGN PATENT DOCUMENTS

DE 37 22 667 A 10/1987
DE 44 20 621 A1 12/1994
FR 2 706 579 A 12/1994
JP 408166173 A * 6/1996
WO WO 03/056232 A1 * 7/2003

* cited by examiner

*Primary Examiner*—Mohammad M. Ali
(74) *Attorney, Agent, or Firm*—Harness, Dickey & Pierce

(57) ABSTRACT

A cryogenic fluid distribution device may include a fluid flow passage for distributing cryogenic fluid to an apparatus, an overflow passage positioned downstream of the apparatus, and a sensor coupled to the overflow passage, the sensor having an active component for determining if fluid is present in the overflow passage.

9 Claims, 6 Drawing Sheets

AUTOMATIC LN2 DISTRIBUTION SYSTEM FOR HIGH-PURITY GERMANIUM MULTI-DETECTOR FACILITIES

FIELD OF THE INVENTION

The present invention generally relates to fluid control devices and methods.

BACKGROUND ART

It is common practice to cool certain types of radiation detectors to cryogenic temperatures where high precision is required. Cooling of the detectors to a very low temperature reduces the effects of thermal noise on the detectors' output signals.

To maintain the detectors at both a relatively low and substantially constant temperature, the detectors are normally thermally isolated from the ambient environment by insulation. Moreover, a cooling agent, commonly liquid nitrogen, normally cools the detectors. However, other liquefied gasses may be used depending on the temperature at which the detectors should be maintained.

A known type of cryogenically cooled detector structure includes a Dewar in which inner and outer vessels forming the Dewar are cylindrical and are constructed of aluminum. The inner vessel is suspended from the top of the outer vessel by a short, thick, fiberglass-epoxy tube that is cemented at its junctions with the inner and outer vessels with epoxy resin. The tube provides thermal isolation between the inner and outer vessels, but permits liquid cooling agent to be manually poured into the inner vessel through a hole in the top of the outer vessel.

A detector may be mounted to the cylindrical outer surface of the inner vessel so that heat from the detector can be transferred directly to the relatively cool wall of the inner vessel. Radiation may be admitted to the detector through a window mounted in the cylindrical sidewall of the outer vessel. Typically, this window is held in place by a custom formed copper fitting and an elastomer o-ring engaged to the fitting to seal the space between the inner and outer vessels from the ambient atmosphere.

Cryogenically cooled detector structures that include Dewars that use liquid nitrogen or other cooling agents should be refilled with the cryogenic coolant on a periodic basis to replace liquid coolant that has evaporated over time. This is accomplished via a fill port integral with the detector structures. Conventionally, this refilling of the detector structures requires the manual intervention of an operator on a regular basis.

SUMMARY OF THE INVENTION

An exemplary embodiment of the present invention provides a cryogenic fluid distribution device that includes a fluid flow passage for distributing cryogenic fluid to an apparatus, an overflow passage positioned downstream of the apparatus, and a sensor coupled to the overflow passage, the sensor having an active component for determining if fluid is present in the overflow passage.

Yet another exemplary embodiment of the present invention provides a method of controlling fluid flow to a spectrometer detector element, including detecting a presence of fluid within an overflow passage using a sensor having an active sensor element associated therewith, sending a voltage level signal produced by the active sensor element to a control device, and receiving a signal from the control device for terminating a flow of fluid to the detector element.

BRIEF DESCRIPTION OF THE DRAWINGS

Exemplary embodiments of the present invention will become more fully understood from the detailed description given hereinbelow and the accompanying drawings which are given by way of illustration only, wherein like reference numerals designate corresponding parts in the various drawings, and wherein.

DETAILED DESCRIPTION OF THE EXEMPLARY EMBODIMENTS

Radiation Detection Apparatus

Figure 1:
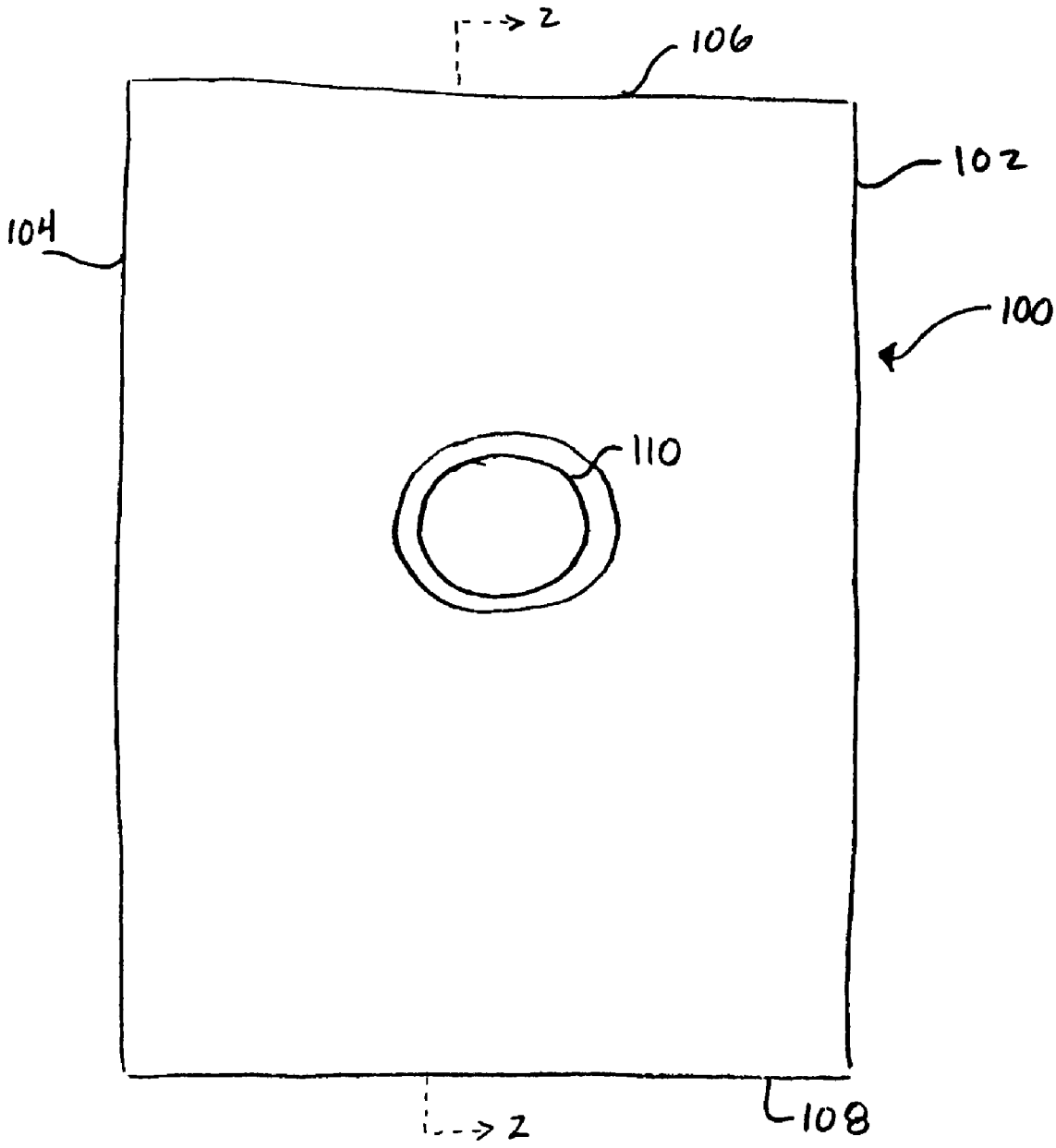
FIG. 1 illustrates a cryogenically cooled radiation detection apparatus in accordance with an exemplary embodiment of the present invention.

FIG. 1 illustrates a cryogenically cooled radiation detection apparatus 100 in accordance with an exemplary embodiment of the present invention. The detection apparatus 100 includes an outer vessel 102 having a generally cylindrical outer sidewall 104, a flat top wall 106 and a bottom wall 108. A window structure 110 is formed in the cylindrical outer sidewall 104. This window structure 110 may be omitted depending on the type of radiation being measured.

Figure 2:
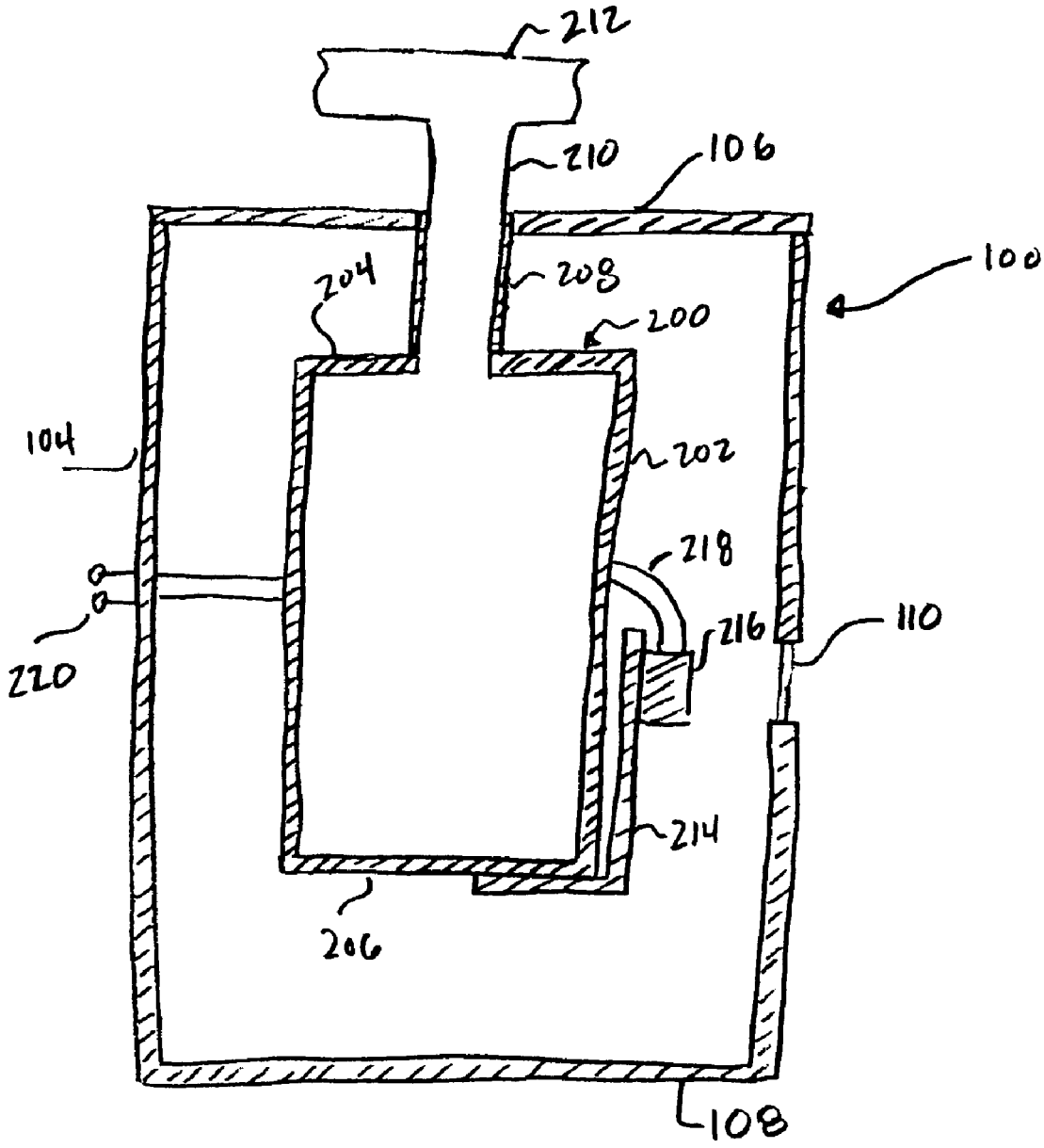
FIG. 2 illustrates a cross-section of the cryogenically cooled radiation detection apparatus in accordance with an exemplary embodiment of the present invention, taken generally along lines 2-2 of FIG. 1.

FIG. 2 illustrates a cross-section of the cryogenically cooled radiation detection apparatus 100 in accordance with an exemplary embodiment of the present invention, taken generally along lines 2-2 of FIG. 1. As is illustrated, a cylindrical inner vessel 200 is disposed within the internal cavity of the outer vessel 102. The cylindrical inner vessel 200 includes a generally cylindrical outer sidewall 202, a top wall 204 and a bottom wall 206. The walls of the cylindrical inner vessel 200 define an interior space for holding cryogenic coolant, such as liquid nitrogen.

The cylindrical inner vessel 200 is connected to the outer vessel by way of a suspending tube 208 that has a hollow bore that provides access to the cylindrical inner vessel 200 from exterior of the cylindrical inner vessel 200. The suspending tube 208 is used to fill the cylindrical inner vessel 200 with a desired cryogenic coolant. According to one exemplary embodiment of the present invention, an external fill tube 210, connected to a cryogenic coolant distribution line 212, is used to fill the cylindrical inner vessel 200. As will be described, the use of the external fill tube 210 and the cryogenic coolant distribution line 212 minimize user intervention when additional cryogenic coolant is needed in the inner vessel 200.

As is further illustrated in FIG. 2, the cylindrical inner vessel 200 may have a mounting member 214 attached in good thermal contact to the bottom wall 206. The mounting member 214 is designed to receive a radiation detector 216. Heat produced by the detector 216 is conducted away therefrom and through the mounting member 214 to the cylindrical inner vessel 200.

The detector 216 may include wires 218 that are coupled to terminals 220. Therefore, signals transmitted from the radiation detector 216 may be analyzed by signal processing equipment (not shown) appropriately attached to the terminals 220.

Fluid Distribution Arrangement

Figure 3:
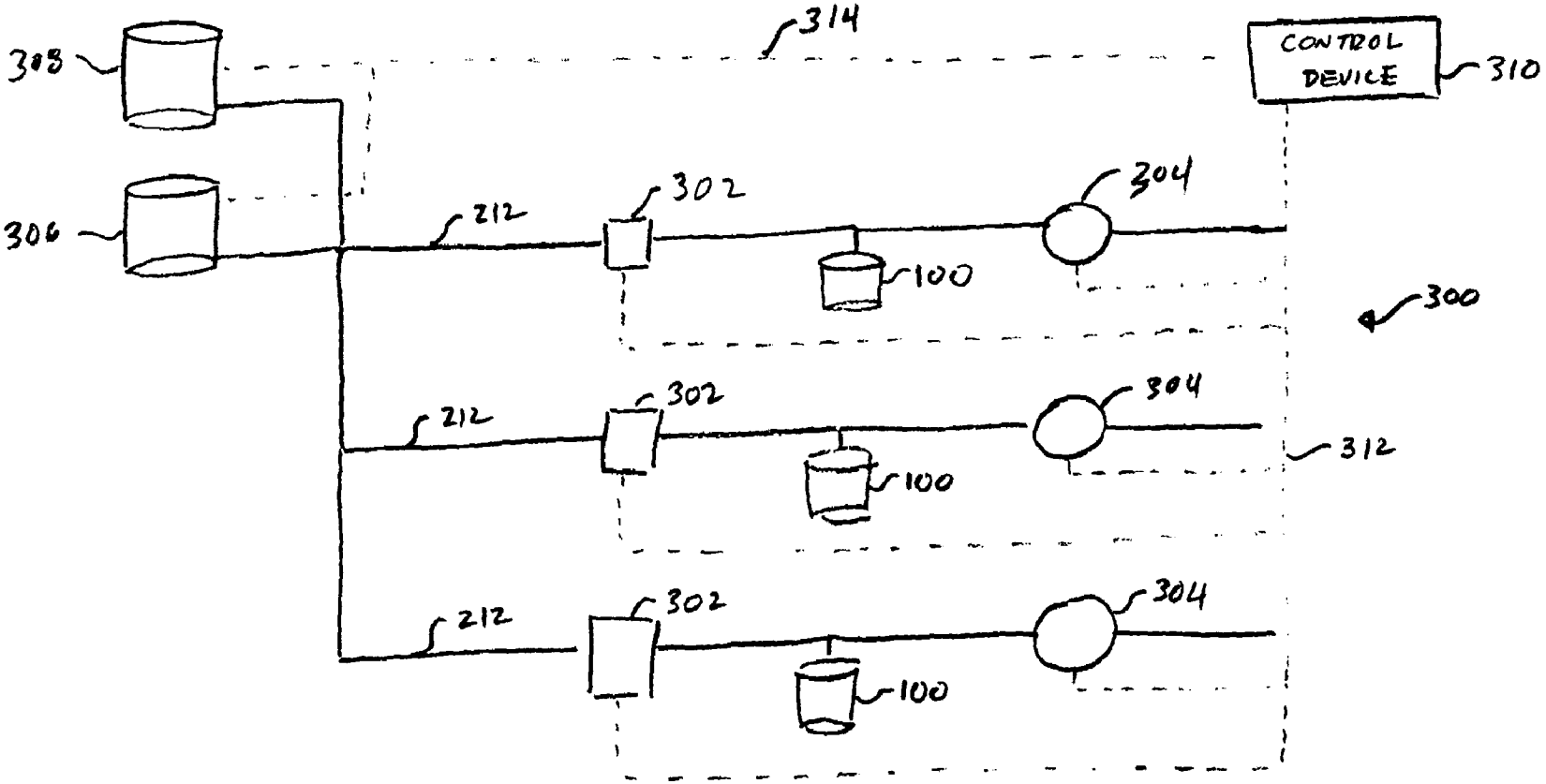
FIG. 3 illustrates a plurality of cooled radiation detection apparatus connected to a fluid distribution arrangement according to an exemplary embodiment of the present invention.

FIG. 3 illustrates a plurality of cooled radiation detection apparatus 100 connected to a fluid distribution arrangement 300 according to an exemplary embodiment of the present invention. The arrangement 300 includes a plurality of valves 302 coupled inline with the cryogenic coolant distribution line 212. Furthermore, the arrangement 300 includes a plurality sensors 304 coupled inline with the distribution line 212. The distribution lines 212 in the vicinity of the sensors 304 may be considered overflow lines.

The distribution line 212 may be connected to several sources. In the exemplary embodiment illustrated in FIG. 3, the distribution line 212 is connected to a liquid nitrogen source 306 and a dry nitrogen source 308. The liquid nitrogen source 306 is used as a coolant supply source for the plurality of cryogenically cooled radiation detection apparatus 100. The dry nitrogen source 308 is used to purge the distribution line 212 before liquid nitrogen is supplied to the plurality of cryogenically cooled radiation detection apparatus 100. This purging process by way of the dry nitrogen supplied by the dry nitrogen source 308 is designed to purge any condensation that may have accumulated in the distribution line 212. Dry nitrogen from the dry nitrogen source 308 may be used before the release of liquid nitrogen from the liquid nitrogen source 306 and/or after the liquid nitrogen has been supplied to the plurality of cryogenically cooled radiation detection apparatus 100.

A control device 310 according to an exemplary embodiment of the present invention may be used to control the flow of liquid nitrogen to the plurality of cryogenically cooled radiation detection apparatus 100. The control device 310 is also used to control dry nitrogen flow to the distribution line 212 before and/or after a flow of liquid nitrogen is caused to flow therethrough. Distribution of the dry nitrogen from the dry nitrogen source 308 generally occurs immediately before and/or after distribution of liquid nitrogen from the liquid nitrogen source 306. Flow control of the dry nitrogen is provided by the control device 310, via signals communicated over a signal line 314.

Control, activation and deactivation signals may be transmitted by the control device 310 to the various elements of the arrangement 300 via a signal line 312 and the signal line 314. Generally, signal line 312 handles signals designated for control of the valves 302 and the sensors 304, while signal line 314 handles signals designated for emergency manual control of the liquid nitrogen source 306 and the dry nitrogen source 308. Emergency control of the valves 302 and the sensors 304 is also available via the signal line 312 and the control device 310, in one exemplary embodiment of the present invention. Emergency control in the context of the liquid nitrogen source 306, the dry nitrogen source 308, the valves 302 and the sensors 304 generally refers to manual control of these respective devices by way of direct user interfacing.

In one exemplary embodiment of the present invention, the signal line 312 handles all control signals from the control device 310, where these signals are for automatic cooling of one or more of the plurality of cryogenically cooled radiation detection apparatus 100. The signal line 312 also handles control signals from the control device 310 that are needed for certain other operational characteristics of the arrangement 300. For example, the control signals from the control device 310 may activate and deactivate values and/or any light indicators on a front panel of the control device 310. Additionally, the signal line 314, in one exemplary embodiment of the present invention, handles all control signals from the control device 310 that are associated with manual and/or emergency control.

The control device 310, according to one embodiment of the present invention, operates in a timed distribution manner. That is, the control device 310 is capable of sending a control signal to one of or a plurality of the valves 302 to thereby toggle the respective valve 302 to an open state. Once a valve is in the open state, liquid nitrogen from the liquid nitrogen source 306 flows to the associated cryogenically cooled radiation detection apparatus 100. As the cryogenically cooled radiation detection apparatus 100 is being filled, liquid nitrogen will not traverse the associated sensor 304. However, once the cryogenically cooled radiation detection apparatus 100 is full, liquid nitrogen will flow towards and traverse the sensor 304. The sensor 304 detects the presence of the liquid nitrogen and sends a signal back to the control device 310. Once the signal from the sensor 304 is received, the control device 310 sends a control signal to the valve 302 to cause the valve to toggle back to a closed state. When the valve 302 is toggled to a closed state, liquid nitrogen will not flow to the cryogenically cooled radiation detection apparatus 100. The various signals are communicated over the signal line 312.

Control Device

Figure 4:
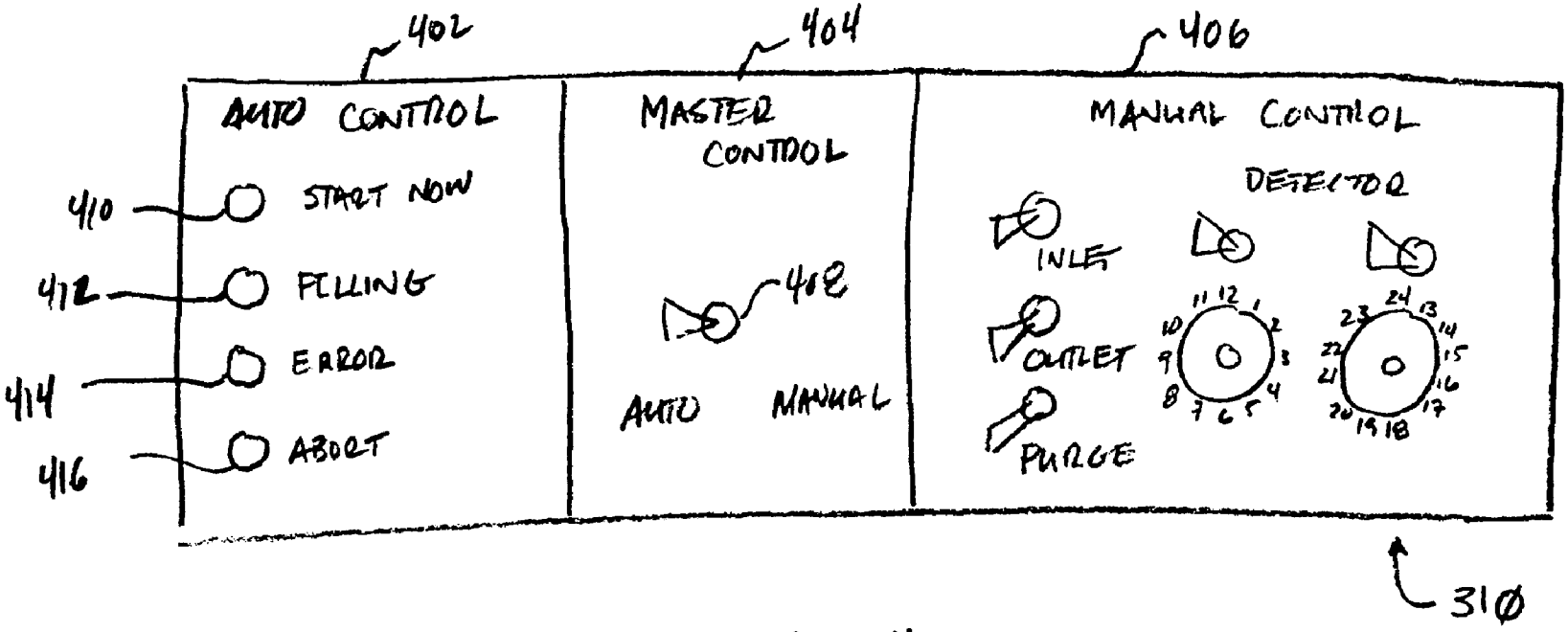
FIG. 4 illustrates a control device according to an exemplary embodiment of the present invention.
Figure 5:
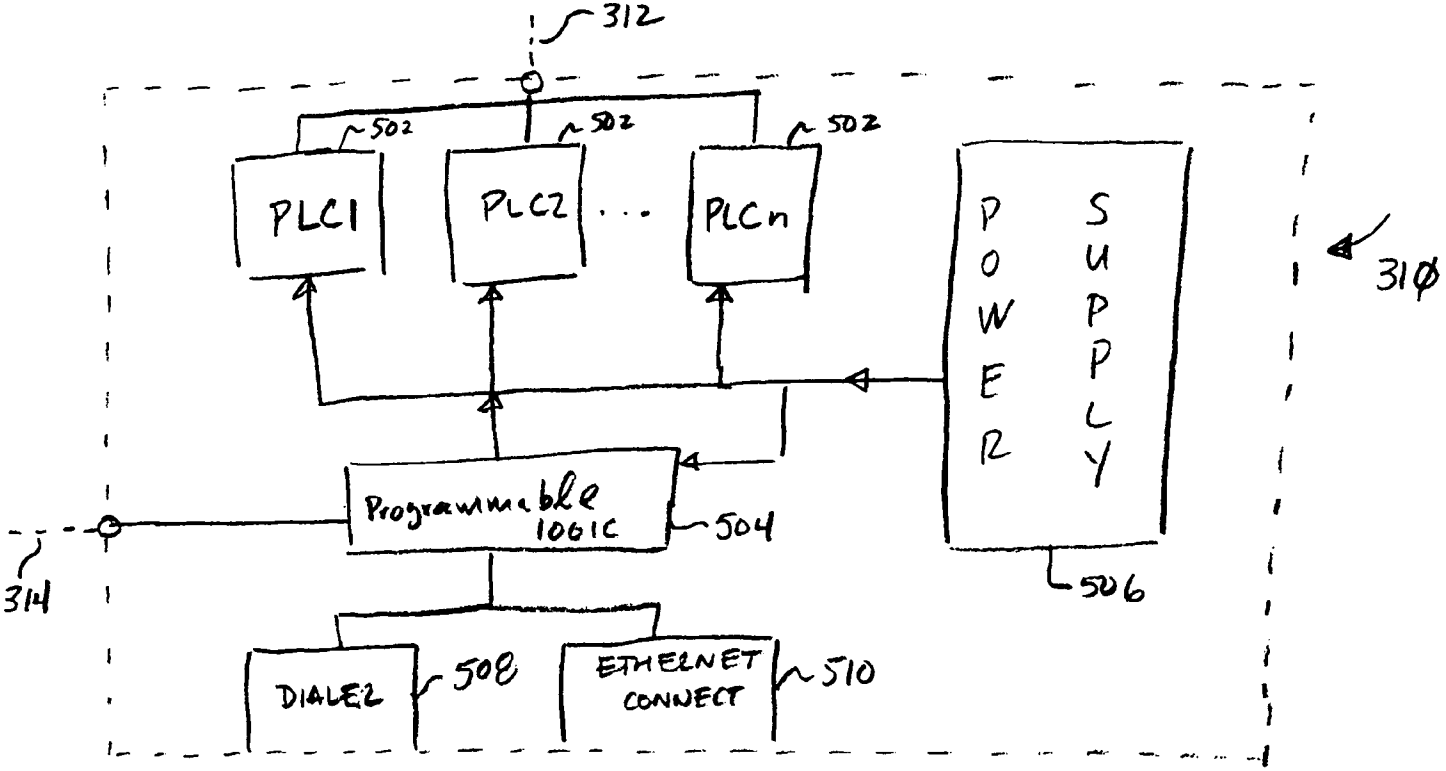
FIG. 5 illustrates a block diagram of the various components of a control device in accordance with an exemplary embodiment of the present invention.

FIG. 4 illustrates the control device 310 (front panel user interface shown in detail) according to an exemplary embodiment of the present invention. FIG. 5 illustrates a block diagram of the various components of the control device 310 in accordance with an exemplary embodiment of the present invention.

With reference to FIGS. 4 and 5, the control device 310 generally includes a plurality of programmable logic controllers (PLCs) PLC1, PLC2 and PLCn interfaced with the signal line 312. The PLC are used to control the distribution of liquid nitrogen. The control device 310 also includes a user programmable logic device 504 interfaced with the PLCs and connected to the signal line 312 for controlling distribution of dry nitrogen. Distribution of the dry nitrogen is generally controlled by logic defined within the user programmable logic device 504. A power supply 506 is used in the control device 310 to provide voltage, and an Ethernet connection 510 is provided to allow for remote control of the control device 310. A dialer 508 is provided to allow the control device 310 to call a phone number or a plurality of phone numbers in order to provide information regarding a current status of a given fluid distribution process. For example, the control device 310, in conjunction with the dialer 508, may provide a digitized message to a phone number or a plurality of phone numbers programmed in the control device 310. These phone numbers may be stored in resident memory of the dialer 508. Although the control device 310 is illustrated having the user programmable logic device 504, which acts as a central control device, it is also possible to implement a control device 310 that includes logic devices for each of the PLCs.

A front panel of the control device 310 includes an auto control section 402, a master control section 404 and a manual control section 406. The auto control section 402 is active when the master control switch 408 is switched to Auto, and the manual control section 406 is active when the master control switch is switched to Manual.

When the master control switch 408 is switched to Auto, the PLCs of the control device 310 will control the distribution of the liquid nitrogen to one of or a plurality of the cryogenically cooled radiation detection apparatus 100. In particular, in Auto, distribution of the liquid nitrogen occurs after the elapse of a certain amount of preprogrammed time. A cycle for distribution of the liquid nitrogen under PLC control may also commence once a start now button 410 is depressed by a user. Generally, the start now button 410 may be used to start distribution of the liquid nitrogen if such distribution is desired out of cycle. Out of cycle refers to causing distribution of the liquid nitrogen before automatic control commences when the master control switch 408 is in Auto. An out of cycle distribution of liquid nitrogen will reset the preprogrammed time for the next distribution of liquid nitrogen in the Auto mode.

Remote activation is also possible via the Ethernet connection 510. A filling light 412 will activate to indicate liquid nitrogen is currently filling at least one cryogenically cooled radiation detection apparatus 100. The filling light 412 will blink if a fill cycle is pending, and the filling light 412 will burn solid if a fill is currently underway.

Whether or not liquid nitrogen is distributed immediately to at least one cryogenically cooled radiation detection apparatus 100, once the start now button 410 is depressed, depends on the current logic stored in the programmable logic device 504. In particular, in one exemplary embodiment of the present invention, the programmable logic device 504 is programmed to fill each of the cryogenically cooled radiation detection apparatus 100 every eight hours. Moreover, according to an exemplary embodiment of the present invention, the user programmable logic device 504 may contain logic instructions that require a fill cycle to begin each time the start now button 410 is depressed. In such a case, the preprogrammed cycle for filing the cryogenically cooled radiation detection apparatus 100 will be reset. For example, if a fill cycle is set to being every eight hours, and the start now button 410 is depressed before the eight hours has elapsed thereby causing a fill to occur out of cycle, the next automatic fill will occur eight hours after the button 410 was depressed. In one exemplary embodiment, used of the start now button 410 requires that the control device 310 is in manual mode.

The auto control section 402 also includes an error light 414 for indicating if an error has occurred in the filling process. Moreover, the auto control section 402 includes an abort switch 416, should a user need to manually abort a filling cycle.

If the master control switch 408 is switched to Manual, then the manual control section is active, and the switches of the auto control section are disabled. Moreover, control via the user programmable logic device 504 is suspended. Under manual control, the various switches allow for the filling of a selected detector as desired by a user manipulating the control device 310. A user may select a detector using rotary switches 420. Once a detector is selected, the user may manipulate switches 422 to effectuate a desired result.

Sensors

Figure 6:
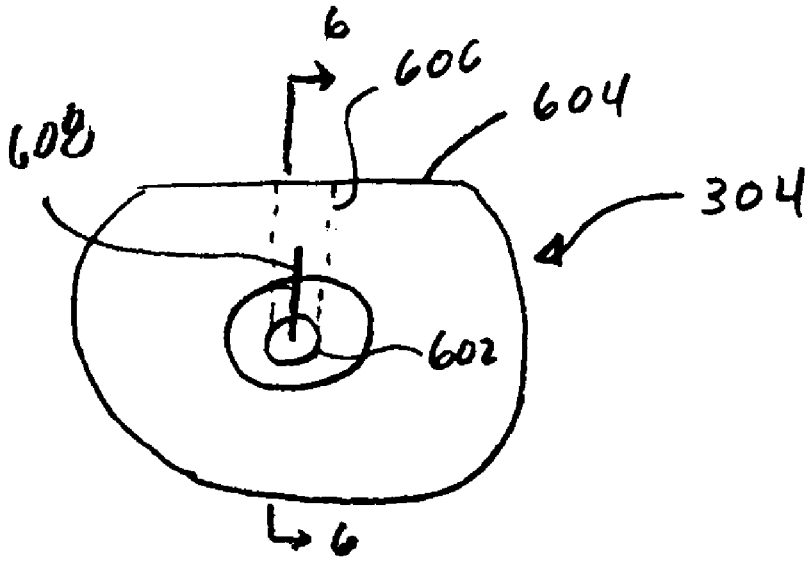
FIG. 6 illustrates one distal end view of a sensor in accordance with an embodiment of the present invention.
Figure 7:
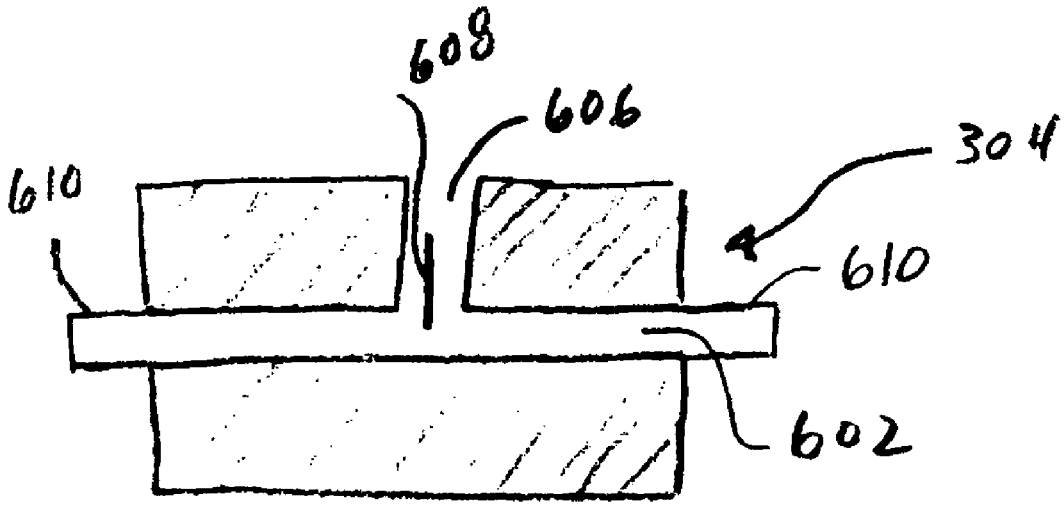
FIG. 7 illustrates a cross-section of the sensor of FIG. 6 according to an exemplary embodiment of the present invention, taken generally along lines 6-6.

FIG. 6 illustrates a distal end view of one of the sensors 304 in accordance with an embodiment of the present invention. FIG. 7 illustrates a cross-section of the sensor 304 of FIG. 6 according to an exemplary embodiment of the present invention, taken generally along lines 6-6.

As is illustrated in FIGS. 6 and 7, the sensor 304 includes a body 604, which may be generally made of a hardened plastic, or the like. The body 604 includes a through passage 602 and a hole 606, originating from a top flat portion of the body 604, that intersects with the passage 602. The hole 606 is designed to receive an active electrical component 608, such as a light emitting diode (LED). At both distal ends of the sensor 304, hose fittings 610 are used in order to facilitate connection of the sensor 304 to the distribution line 212.

Operationally, as liquid nitrogen flows through the passage 605 (i.e. when one of the cylindrical inner vessels 200 is at capacity), the active component 608 will register the presence of the liquid nitrogen thereby allowing the control device 310 to react by sending a control signal via the signal line 312 to toggle to close a respective valve 302. In the case where an LED is used as the active component 608, a voltage will be sent to the control device 310 to indicate the presence of liquid nitrogen at the sensor 304.

Alternatives

Although the exemplary embodiments have been discussed in conjunction with a system employing a radiation detector, the present invention is not limited as such. In particular, the present invention may also be implemented with other systems and arrangements requiring distribution of fluids, where those fluids may reach an overflow state.

Although the exemplary embodiments have been discussed in relation to three cryogenically cooled radiation detection apparatus, this is not limiting of the present invention. In particular, a number of cryogenically cooled radiation detection apparatus greater than or less than three is also embraced the present invention. Similarly, a control device of the type discussed herein may be capable of handling a large volume of cryogenically cooled radiation detection apparatus. This would be as simple as adding more PLCs, or using PLCs that are robustly superior as far as controllability is concerned.

Although the exemplary embodiments have been discussed and illustrated as having a distribution line that is generally perpendicular to a distribution line (see FIG. 2), this is by way of example only. In particular, the distribution line may be generally straight and connect directly to the fill tube. This arrangement would offer a coaxial tube design, where the distribution line is positioned inside an overflow tube. When an capacity is reached in the cryogenically cooled radiation detection apparatus, liquid nitrogen would flow upward into the overflow tube and across the sensor, thereby triggering the control device to shutoff the associated valve.

The exemplary embodiments of the present invention provide an enhanced fluid distribution system that requires limited user intervention. This is advantageous in environments where manpower may be limited, or during periods when operational personal are unavailable.

Exemplary embodiments of the present invention being thus described, it will be obvious that the same may be varied in many ways. Such variations are not to be regarded as a departure from the spirit and scope of the invention, and all such modifications are intended to be included within the scope of the following claims.

What is claimed is:

1. A cryogenic fluid distribution device, comprising:

a fluid flow passage for distributing cryogenic fluid to an apparatus;

an overflow passage positioned downstream of the apparatus; and a sensor coupled to the overflow passage, the sensor having an active component for determining if fluid is present in the overflow passage wherein the active component is a light emitting diode.

2. A cryogenic fluid distribution device, comprising:

a fluid flow passage for distributing cryogenic fluid to an apparatus;

an overflow passage positioned downstream of the apparatus; and a sensor coupled to the overflow passage, the sensor having an active component for determining if fluid is present in the overflow passage, wherein the sensor includes a body having a through passage therein defining a flow area for fluid, the sensor further including a hole intersecting with the through passage.

3. The device according to claim 2, wherein the active component is positioned within the hole and impinges into the through passage.

4. The device according to claim 3, wherein the active component is a light emitting diode.

5. An apparatus for distributing cryogenic liqiuid to a cooled device, comprising:

a cryogenic liqiuid reservoir having an inlet and an outlet;

a cooled device having an inlet and an outlet;

a supply passage connecting the reservoir outlet and the device inlet for delivery of a cryogenic liqiuid from the reservoir to the device;

a valve coupled to the supply passage and operable for controlling a flow of the cryogenic liqiuid within the supply passage;

an overflow passage connected to the device outlet; and a sensor coupled to the overflow passage, the sensor having an active component configured for determining if cryogenic liqiuid is present in the overflow passage, wherein the active component is a light emitting diode.

6. An apparatus for distributing cryogenic liqiuid to a cooled device, comprising:

a cryogenic liquid reservoir having an inlet and an outlet;

a cooled device having an inlet and an outlet;

a supply passage connecting the reservoir outlet and the device inlet for delivery of a cryogenic liqiuid from the reservoir to the device;

a valve coupled to the supply passage and operable for controlling a flow of the cryogenic liquid within the supply passage;

an overflow passage connected to the device outlet; and a sensor coupled to the overflow passage, the sensor having an active component configured for determining if cryogenic liqiuid is present in the overflow passage wherein the sensor includes a sensor body, the sensor body being configured to define a fluid flow path through the sensor body; and a recess opening into the fluid flow path.

7. The apparatus according to claim 6, wherein: the active component is positioned within the recess.

8. The apparatus according to claim 7, wherein:

a portion of the active component extends from the recess into the fluid flow path.

9. The apparatus according to claim 8, wherein: the active component is a light emitting diode.

* * * * *